United States Patent [19]

Büchl

[11] Patent Number: 4,846,120

[45] Date of Patent: Jul. 11, 1989

[54] METHOD OF OPERATING AN INTERNAL COMBUSTION ENGINE

[76] Inventor: Josef Büchl, Rehsteig 12, D-8071 Lenting, Fed. Rep. of Germany

[21] Appl. No.: 19,242

[22] PCT Filed: Jun. 25, 1986

[86] PCT No.: PCT/EP86/00376

§ 371 Date: Mar. 2, 1987

§ 102(e) Date: Mar. 2, 1987

[87] PCT Pub. No.: WO87/00239

PCT Pub. Date: Jan. 15, 1987

[30] Foreign Application Priority Data

Jul. 5, 1985 [DE] Fed. Rep. of Germany ..... 3524024

[51] Int. Cl.[4] ..... F01L 1/34

[52] U.S. Cl. ..... 123/90.11

[58] Field of Search ..... 123/90.11

[56] References Cited

U.S. PATENT DOCUMENTS

| | | | |
|---|---|---|---|
| 1,038,598 | 9/1912 | Kellum | 123/90.11 |
| 1,096,955 | 5/1914 | Rock | 123/90.11 |
| 1,471,861 | 10/1923 | Perrault | 123/90.11 |
| 3,853,102 | 12/1974 | Myers et al. | 123/90.11 |
| 3,882,833 | 5/1975 | Longstaff et al. | 123/90.11 |
| 4,515,343 | 5/1985 | Pischinger et al. | 123/90.11 |
| 4,544,986 | 10/1985 | Buchl | 123/90.11 |
| 4,614,170 | 9/1986 | Pischinger et al. | 123/90.11 |

FOREIGN PATENT DOCUMENTS

| | | | |
|---|---|---|---|
| 301444 | 11/1928 | United Kingdom | 123/90.11 |

*Primary Examiner*—Willis R. Wolfe
*Assistant Examiner*—M. Macy
*Attorney, Agent, or Firm*—Karl Hormann

[57] ABSTRACT

A method is proposed for operating an internal combustion engine provided with gas exchange valves in which the gas exchange valves are maintained in their open and closed positions by the holding force of magnets. When internal pressure within a cylinder increases sharply during the combustion process the holding force for maintaining the valve in its closed position is reduced.

6 Claims, 1 Drawing Sheet

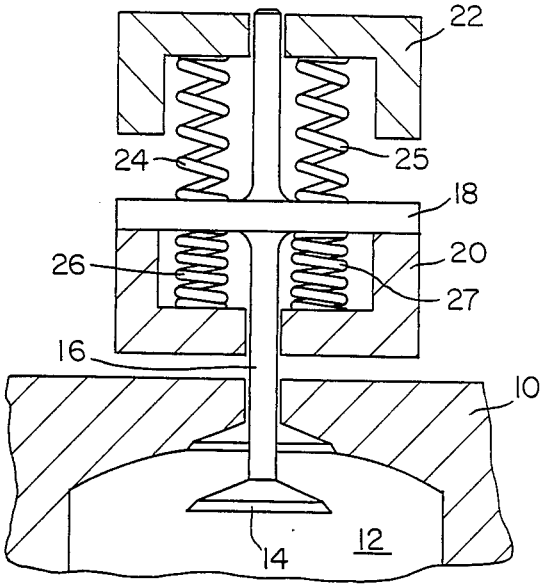
FIG. 1
FIG. 2
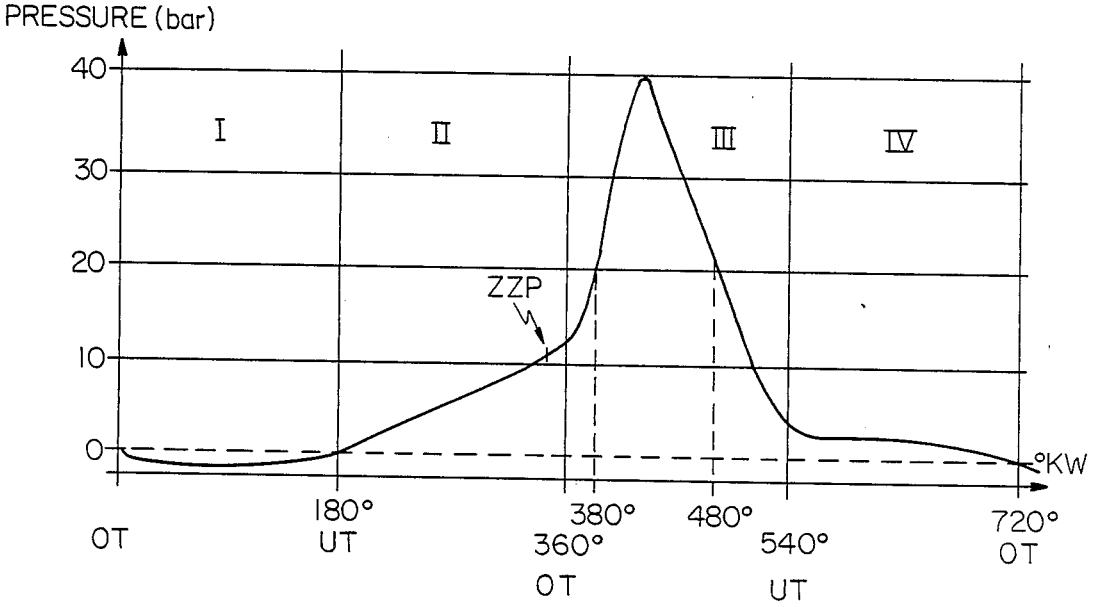

METHOD OF OPERATING AN INTERNAL COMBUSTION ENGINE

The invention relates to a method of operating an internal combustion engine as defined in the generic portion of claim 1.

An internal combustion engine of this kind is known, for instance, from DE-OS No. 30 24 109. The gas exchange valve or valves are maintained in their closed position in that an electromagnet is energized and attracts an armature. A spring system biases the valve in the opening direction, so that upon deenergization of the electromagnet the spring system becomes active and opens the valve. However, when the electromagnet is energized its force is sufficient to maintain the armature in the closed position the bias of the spring system notwithstanding.

Hence, it is necessary to use electrical energy to maintain the valve in its closed position.

The task of the invention resides in operating an internal combustion engine equipped with a gas exchange valve in such a manner that the energy requirements are reduced. As used herein, the term gas exchange valve is intended to connote either fuel intake valve or exhaust valve.

The task is solved by the elements enumerated in the main claim.

In accordance with the invention use is made of the fact that during the combustion process high internal pressure develops in the interior of a cylinder which high pressure is acting upon the valve head. Thus the valve is subjected to a force which additionally pushed it against its seat in the direction of closing. During the effectiveness of this force the holding force to be generated by the magnet may therefore be reduced for the magnet need now only compensate for the spring bias less the force acting upon the valve head.

Since the internal pressure of a cylinder is not constant during the combustion process, the flow of current through the electromagnet, in a preferred embodiment of the invention, is controlled, the degree of current flow being dependent from the interior pressure of the cylinder.

It is difficult to derive a direct measure of the interior pressure of the cylinder; however empirical values indicative of the buildup of the interior pressure are available. Therefore, in accordance with a preferred embodiment of the invention the flow of current through the electromagnet may be controlled as a function of time whereby the level of current flow is a function of the empirically determined buildup of interior pressure within the cylinder during a combustion or compression phase.

When the interior pressure in the cylinder exceeds the force of the spring for pushing the valve into its open position the flow of current through the magnet may even be completely discontinued.

For synchronizing the pattern of current flowing through the electromagnet with the build-up of pressure in the cylinder, the instant of ignition may be utilized, for because of the ignition of the mixture within the cylinder the interior pressure rises sharply beginning with the instant of ignition. Thus, the instant of ignition defines the starting point for the buildup of the interior pressure in the cylinder.

The invention is explained hereinafter on the basis of the drawing.

FIG. 1 is a schematic presentation, in longitudinal section, of structure for practicing the invention; and FIG. 2 is a diagram of the operation of a four cycle piston engine for explaining the invention.

As mentioned supra, the method in accordance with the invention may be practised in an internal combustion engine of the kind disclosed by DE-OS No. 30 24 109. It is essential that the valve arrangement be as follows: A cylinder head 10 encloses the upper portion of the internal chamber 12 of a cylinder within which combustion processes of the kind customary in a combustion engine take place in a known manner. A valve 14, shown in FIG. 1 in its open position, i.e. lifted from its seat, is provided for opening the intake and/or the exhaust. At its shank 16 the valve 14 is provided with an armature plate 18 which may axially oscillate to and fro between pole faces of a magnet 20 and a magnet 22. When the armature plate 18 is attracted against the magnet 20 the valve is open, and when the armature plate 18 is attracted against the magnet 22 the valve 14 is closed. However, the valve 14 is not moved from its engagement with the pole face of a magnet into engagement with the pole face of the other magnet by magnetic attraction forces; rather, there is provided a system of springs 24, 25, 26, 27, the springs 24 and 25 pushing the armature plate 18 from its engagement with the pole face of the magnet 22, whereas the springs 26 and 27 push the armature plate 18 out of engagement with the pole faces of the magnet 20. The null of this spring system is such that when the magnets 20 and 22 are not energized the armature plate 18 assumes a position substantially halfway between the pole surfaces of the magnets 20 and 22.

As shown in FIG. 1 the magnet 20 is energized to maintain the armature plate 18 in engagement with the pole face of the magnet 20 even though the armature plate 18 is subjected to the force of the springs 26 and 27 which bias the armature plate 18 in a direction away from the pole face. When current flow through the magnet 20 is discontinued the armature plate 18 is accelerated by the springs 26 and 27 which acceleration is retarded upon engagement with the springs 24 and 25 but which is sufficient to move the armature plate 18 at least adjacent the pole face of the magnet 22. If at this instant the magnet 22 is energized the armature plate 18 will be maintained in engagement with the pole faces of the magnet 22 and the valve 14 is closed.

To maintain the valve 14 in its closed position it is necessary to maintain current flow in the electromagnet 22.

The level of current must be such that it compensates for the force of the springs 24 and 25.

In accordance with the invention it has been recognized that during a portion of an operating cycle of a four cycle combustion engine, or of a two cycle engine provided with valves, an additional force is applied to the head of the valve 14 which force presses the valve against its seat. This force acts in the same direction as the force to be generated by the electromagnet 22 for attracting the the armature plate 18 so that the force to be applied by the electromagnet 22 may be reduced by the force generated by the internal pressure in the cylinder.

FIG. 2 depicts a diagram of an operational cycle of a four cycle internal combustion engine; as is known, an ignitable mixture is drawn into the cylinder chamber during phase I; during phase II, positioned between 180° and 360° of rotational crank shaft angle, i.e. between the upper and lower dead center positions, the mixture is compressed for ignition shortly before the upper dead center has been reached. Therefore, after the upper dead center has been reached the internal pressure in the cylinder increases sharply during phase III, and a substantial pressure is exerted against the head of the piston for driving the internal combustion engine. In conventional four cycle Otto engines the pressure may go as high as 40 bar; in Diesel engines it may be noticeably—about three times—higher.

During phase IV the burnt up mixture is exhausted.

Especially during phase III, the working cycle, very high pressures are generated within the cylinder which push the valve 14 against its seat. During this interval, i.e. between substantially 380° and 480° during the course of the 720° rotational crank shaft angle, the flow of current through the magnet 22 may be reduced without any danger of the springs 24 and 25 pushing the valve 14 into its open position.

Advantageously, the flow of current is not controlled as a function of the absolute value of the rotational crank shaft angle; rather the flow of current should be synchronized with the instant of ignition. The reduction in current flow through the electromagnet 22 may commence at a predetermined point in time following the instant of ignition, that is to say at a predetermined rotational angle of the crank shaft since it is independent of the rotational speed, and may be maintained, depending upon the characteristics of the engine, for about 100° of crank shaft angle. During this 100° interval the flow pattern of the current may be controlled, or it may simply be reduced to a lower level.

I claim:

1. A method of operating an internal combustion engine having at least one gas exchange valve actuated by an electromagnet for closing a combustion cylinder during an operating cycle of said engine, comprising the steps of:

energizing said electromagnet with current of a level sufficient to move said valve into a position closing said cylinder;

building up pressure within said cylinder; and reducing said current level in said electromagnet in response to said pressure.

2. The method of claim 1, wherein reducing said current level is controlled as a function of time related to the buildup of pressure within said cylinder.

3. The method of claim 2, wherein said valve is moved to its closing position against the bias of a spring, and wherein the step of reducing said current level is taken when said pressure within said cylinder has built up to a level acting upon said valve with a force in excess of the bias of said spring.

4. The method of claim 3, wherein ignition takes place within said cylinder and said step of reducing said level of current is substantially synchronized with said ignition.

5. The method of claim 3, wherein the flow of current is discontinued when the increased pressure within the cylinder exceeds the bias of the spring.

6. The method of claim 4, wherein said engine is a four cycle engine having a 720° duty cycle and said ignition occurs at about 345° and wherein said level of current is reduced in the range from about 380° to about 480°.

* * * * *